US011355866B2

(12) United States Patent
Zhao et al.

(10) Patent No.: US 11,355,866 B2
(45) Date of Patent: Jun. 7, 2022

(54) 5G MMW DUAL-POLARIZED ANTENNA MODULE AND TERMINAL DEVICE

(71) Applicant: SHENZHEN SUNWAY COMMUNICATION CO., LTD., Guangdong (CN)

(72) Inventors: Yue Zhao, Shenzhen (CN); Anping Zhao, Shenzhen (CN)

(73) Assignee: SHENZHEN SUNWAY COMMUNICATION CO., LTD., Shenzhen (CN)

( * ) Notice: Subject to any disclaimer, the term of this patent is extended or adjusted under 35 U.S.C. 154(b) by 101 days.

(21) Appl. No.: 16/769,358

(22) PCT Filed: Apr. 7, 2020

(86) PCT No.: PCT/CN2020/083479
§ 371 (c)(1),
(2) Date: Jun. 3, 2020

(87) PCT Pub. No.: WO2021/139016
PCT Pub. Date: Jul. 15, 2021

(65) Prior Publication Data

US 2022/0006204 A1 Jan. 6, 2022

(30) Foreign Application Priority Data

Jan. 10, 2020 (CN) ..... 202010024430.2

(51) Int. Cl.
*H01Q 1/38* (2006.01)
*H01Q 21/24* (2006.01)
(Continued)

(52) U.S. Cl.
CPC ..... *H01Q 21/24* (2013.01); *H01Q 1/242* (2013.01); *H01Q 1/38* (2013.01); *H01Q 1/48* (2013.01); *H01Q 1/50* (2013.01); *H01Q 9/0407* (2013.01)

(58) Field of Classification Search
CPC ..... H01Q 21/24; H01Q 1/242; H01Q 1/38
(Continued)

(56) References Cited

U.S. PATENT DOCUMENTS

2009/0262023 A1* 10/2009 Ying ..... H01Q 21/28
343/700 MS

FOREIGN PATENT DOCUMENTS

CN 207517869 U 6/2018
CN 108288757 A 7/2018
(Continued)

OTHER PUBLICATIONS

Wu et al.; "A Broadband Dual-polarized Capped Bow-tie 2×2 Antenna Array for 28 GHz Band in 5G Systems;" IEEE; 2018; pp. 825-826.

(Continued)

*Primary Examiner* — Peguy Jean Pierre
(74) *Attorney, Agent, or Firm* — Oliff PLC

(57) ABSTRACT

A 5G MMW dual-polarized antenna module includes a substrate. A metal ground and an antenna unit group are disposed in the substrate. The metal ground partitions the substrate into a first region and a second region. The antenna unit group includes a first antenna unit, a patch antenna and a probe. The first antenna unit includes a first branch and a second branch connected to the first branch, wherein the first branch is disposed in the first region, and an end, away from the first branch, of the second branch is located in the second region. The probe includes a first part and a second part connected to the first part, wherein the second part is
(Continued)

disposed in the first region. The MMW dual-polarized antenna module can fulfill lateral radiation in light and thin terminal devices.

16 Claims, 10 Drawing Sheets

(51) Int. Cl.

| | |
|---|---|
| ***H01Q 1/24*** | (2006.01) |
| ***H01Q 1/48*** | (2006.01) |
| ***H01Q 1/50*** | (2006.01) |
| ***H01Q 9/04*** | (2006.01) |

(58) Field of Classification Search
USPC ..... 343/702
See application file for complete search history.

(56) References Cited

FOREIGN PATENT DOCUMENTS

| | | | |
|---|---|---|---|
| CN | 207781866 | U | 8/2018 |
| CN | 208460981 | U | 2/2019 |
| CN | 208655889 | U | 3/2019 |
| CN | 110416727 | A | 11/2019 |
| CN | 110444855 | A | 11/2019 |
| WO | 2019/186238 | A1 | 10/2019 |

OTHER PUBLICATIONS

Yu et al.; "A Dual-band MIMO Antenna System for 5G Mobile Terminals;" Journal of Microwaves; 2019; pp. 40-44; vol. 35, No. 6.

Oct. 12, 2020 Search Report issued in International Patent Application No. PCT/CN2020/083479.

* cited by examiner

5G MMW DUAL-POLARIZED ANTENNA MODULE AND TERMINAL DEVICE

TECHNICAL FIELD

The invention relates to the technical field of antennas, in particular to a 5G MMW dual-polarized antenna module and a terminal device.

DESCRIPTION OF RELATED ART

The fifth-generation (5G) wireless communication technology will be soon commercially used. In accordance with the communication frequency, 5G can be divided into a sub-6 GHz frequency band and a millimeter wave (MMW) frequency band, wherein the MMW frequency band is rich in spectrum resources, can greatly increase the communication rate and has the advantage of low delay. Compared with previous low-frequency bands which have been widely applied, the path loss during MMW transmission is large, the MMW transmission distance is short, and hence, it is necessary to constitute an array by multiple antenna units to increase the gain and to fulfill a beam-forming capacity.

Accompanied with the technological innovation, new challenges have brought to the design of MMW antennas. Up to now, there have already been some designs of MMW antennas applied to handheld devices, but most existing MMW antennas have certain problems. For example, antennas provided by Chinese Utility Model Patent "5G MMW Mobile Phone Antenna Based on Rectangular Patch Array" (Publication No. CN208655889U), Chinese Utility Model Patent "Four-unit MMW Antenna System for Mobile Communication Terminal" (Publication No. CN208460981U), and Chinese Utility Model Patent "Compact Wideband MMW Antenna" (Publication No. CN207781866U) are all designed based on broadside radiation. These antennas have to be vertically disposed on side faces of mobile phones to fulfill lateral radiation, which directly restrains the ultra-thin design of the mobile phones. Chinese Utility Model Patent "End-radiation MMW Antenna with Controllable Radiation Direction" (Publication No. CN207517869U) and Chinese Utility Model Patent "Wireless Mobile Terminal and Antenna" (Publication No. CN108288757A) provide antenna units that can fulfill end radiation, but such antennas are single-polarized. Dual-polarized antennas can improve the channel capacity, thus being preferred in practical application. Recently, Qualcomm has launched a dual-polarized MMW antenna module based on rectangular patch antennas; however, because the principal radiation direction of the antenna module is perpendicular to the surface of the patch antennas, the antenna module has to be vertically disposed on the side edge of mobile phones, which is not conducive to ultra-thin development of the mobile phones.

BRIEF SUMMARY OF THE INVENTION

The technical issue to be settled by the invention is to provide a MMW dual-polarized antenna module applicable to the frequency band of 37-40 GHZ, and a terminal device. The MMW dual-polarized antenna module can fulfill lateral radiation in light and thin terminal devices.

One technical solution adopted by the invention to settle the aforesaid technical issue is as follows: a 5G MMW dual-polarized antenna module comprises a substrate, wherein a first feed port and a second feed port are formed in the surface of the substrate, a metal ground and at least one antenna unit group are disposed in the substrate, the metal ground partitions the substrate into a first region and a second region, the antenna unit group includes a first antenna unit and a second antenna unit, the second antenna unit comprises a patch antenna and a probe, the patch antenna is parallel to the metal ground, the first antenna unit comprises a first branch and a second branch connected to the first branch, the first branch is disposed in the first region in a height direction of the substrate and is located on one side of the patch antenna, and an end, away from the first branch, of the second branch is located in the second region and is conductive with the first feed port; and the probe comprises a first part and a second part connected to the first part, the second part is disposed in the first region in a length direction of the substrate and is located between the patch antenna and the metal ground, and an end, away from the second part, of the first part is located in the second region and is conductive with the second feed port; and a first ground layer conductive with the metal ground is disposed on the bottom surface of the substrate.

Another technical solution adopted by the invention to settle the aforesaid technical issue is as follows: a terminal device comprises a PCB and the 5G MMW dual-polarized antenna module disposed on at least one side of the PCB.

The invention has the following beneficial effects: the antenna module provided by the invention can fulfill dual polarization, the antenna units make full use of the three-dimensional space of the substrate, and the antenna module can be disposed in the terminal device to fulfill lateral radiation; meanwhile, the substrate occupies a small space, and thus will not restrain the ultra-thin design of the terminal device; and the antenna module is particularly suitable for terminal devices of 5G communication systems and can completely cover the frequency band of n260 (37-40 GHz).

REFERENCE SIGNS

Figure 1:
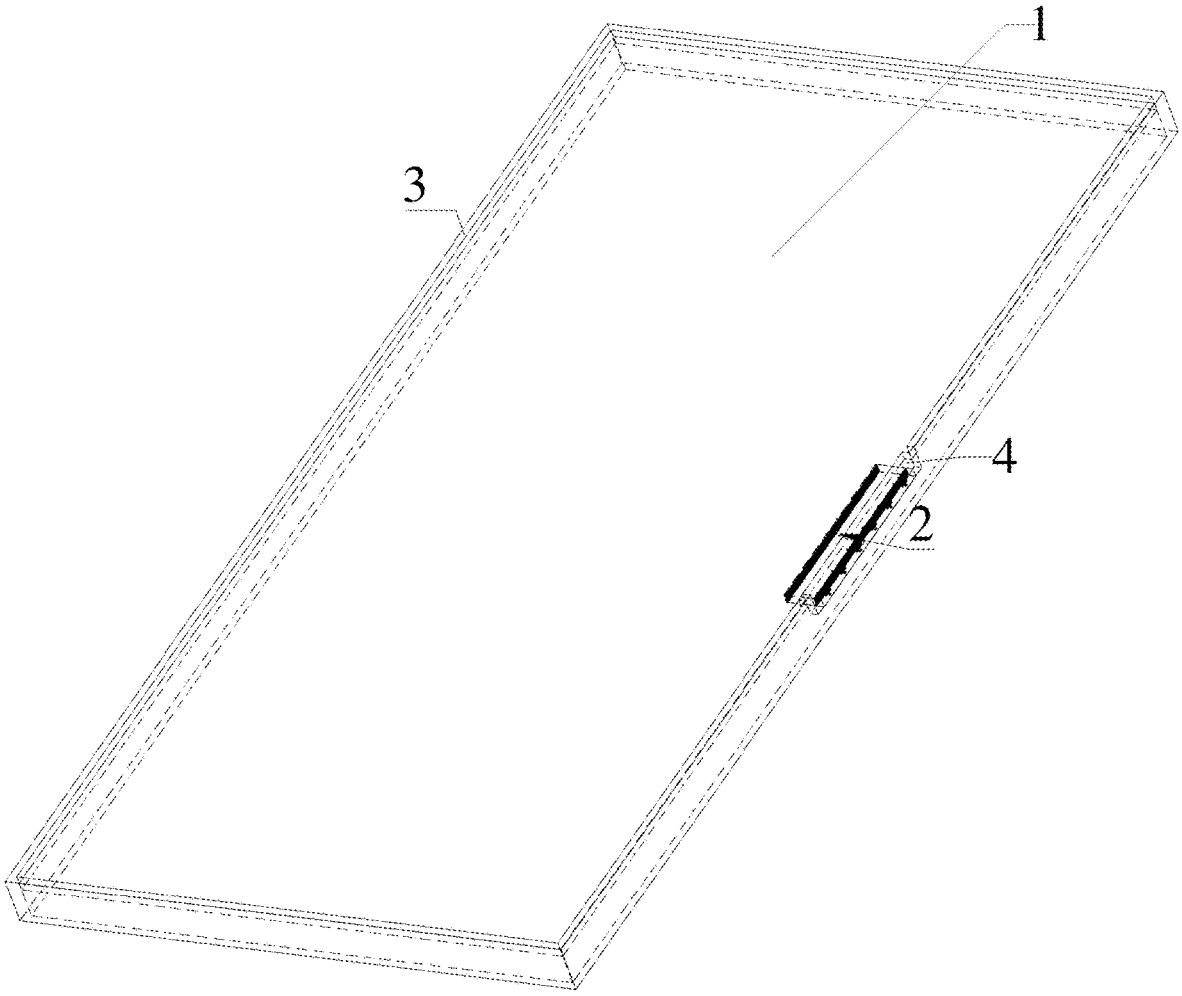
FIG. 1 is a perspective view of a terminal device in Embodiment 1 of the invention.

1, PCB; 2, 5G MMW dual-polarized antenna module; 3, mobile phone frame; 4, notch; 5, substrate; 6, first feed port; 7, second feed port; 8, metal ground; 9, first region; 10, second region; 11, patch antenna; 12, first antenna unit; 13, probe; 14, first branch; 15, second branch; 16, first part; 17, second part; 18, third branch; 19, shield ground; 20, first ground layer; 21, second ground layer; 22, digital integrated circuit chip; 23, radio frequency chip; 24, antenna unit group.

DETAILED DESCRIPTION OF THE SEVERAL VIEWS OF THE DRAWINGS

The technical contents, purposes and effects of the invention are expounded below in conjunction with the embodiments and accompanying drawings.

Referring to FIG. 1 to FIG. 17, a 5G MMW dual-polarized antenna module 2 comprises a substrate 5, wherein a metal ground 8 and at least one antenna unit group 24 are disposed in the substrate 5, the metal ground 8 partitions the substrate 5 into a first region 9 and a second region 10, a first ground layer 20 conductive with the metal ground 8 is disposed on the bottom surface of the substrate 5 and has a first feed port 6 and a second feed port 7 below the second region 10, the antenna unit group 24 includes a first antenna unit 12 and a second antenna unit, the second antenna unit comprises a patch antenna 11 and a probe 13, the patch antenna 11 is parallel to the metal ground 8, the second antenna unit 12 comprises a first branch 14 and a second branch 15, the first branch 14 is disposed in the first region 9 in a height direction of the substrate 5 and is located on one side of the patch antenna 11, the second branch 15 penetrates through a through hole in the metal ground 8, and an end, away from the first branch 14, of the second branch 15 is located in the second region 10 and is conductive with the first feed port 6; the probe 13 comprises a first part 16 and a second part 17, wherein the second part 17 is disposed in the first region 9 in a length direction of the substrate 5 and is located between the patch antenna 11 and the metal ground 8, an end, away from the second part 17, of the first part 16 is located in the second region 10 and is conductive with the second feed port 7, and the first part 16 penetrates through a through hole in the metal ground 8.

The structural principle of the invention is as follows: the first antenna unit 12 can be excited via the first feed port 6 to form an open-circuit loop antenna together with the metal ground 8 and the first ground layer 20, so as to realize vertical polarization of the antenna module; and the probe 13 and the patch antenna 11 can be excited via the second feed port 7 to realize horizontal polarization.

From the above description, the invention has the following beneficial effects: the antenna module provided by the invention can fulfill dual polarization, the antenna unit group 24 makes full use of a three-dimensional space of the substrate 5 and can fulfill lateral radiation after being disposed in a terminal device, and the substrate 5 has a small height and will not restrain the ultra-thin design of the terminal device; and the antenna module is particularly suitable for terminal devices of 5G communication systems and can completely cover the frequency band of n260 (37-40 GHz).

Furthermore, the first antenna unit 12 further comprises a third branch 18 which is disposed in the length direction of the substrate 5, and the first branch 14 and the second branch 15 are connected through the third branch 18.

From the above description, impedance matching of the antenna module can be adjusted by adjusting the distance from the second branch 15 to the first ground layer 20, the width of the second branch 15 and the dimension of the third branch 18.

Furthermore, a second ground layer 21 conductive with the metal ground 8 is disposed on the upper surface of the second region 10, and a shield ground 19 conductive with the first ground layer 20 and the second ground layer 21 is disposed at an end, away from the first region 9, of the second region 10.

From the above description, a metal cavity is defined by the metal ground 8, the shield ground 19, the first ground layer 20 and the second ground layer 21, and different electronic components such as feed lines, filters and switches can be disposed in the metal cavity as required.

Furthermore, the substrate 5 is made of an insulating material, and the patch antenna 11, the metal ground 8 and the shield ground 19 are metal plate structures or metal mesh structures.

From the above description, the antenna module can be manufactured through a multi-layer circuit board or LTCC process, which is more conducive to subsequent chip integration than existing metal frame-based designs. The patch antenna 11, the metal ground 8 and the shield ground 19 may be metal mesh structures which are easy to machine. Each metal mesh structure comprises multiple metal patches which are disposed in the height direction of the substrate 5 in an aligned manner, and every two adjacent metal patches are conductive with each other.

Furthermore, multiple antenna unit groups 24 are disposed in the substrate 5 in an array manner.

Furthermore, a digital integrated circuit chip 22 and a radio frequency chip 23 are disposed below the first ground layer 20.

From the above description, the radio frequency chip 23 feeds power to the multiple antenna unit groups 24. The radio frequency chip 23 comprises a phase shifter, an amplifier and other elements, wherein the phase shifter is used to provide a phase difference for the antenna unit groups 24 to fulfill a beam scanning capacity, and the amplifier is used to compensate for the loss of the phase shifter. The digital integrated circuit chip 22 is used to supply power to the radio frequency chip 23.

A terminal device comprises a PCB 1 and the 5G MMW dual-polarized antenna module 2 disposed on at least one side of the PCB 1.

Embodiment 1

Figure 2:
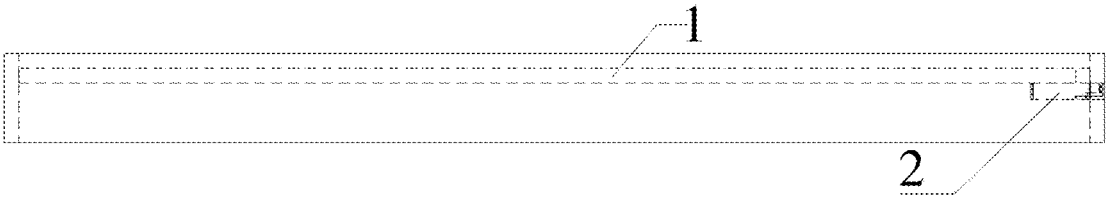
FIG. 2 is a side view of the terminal device in Embodiment 1 of the invention.
Figure 3:
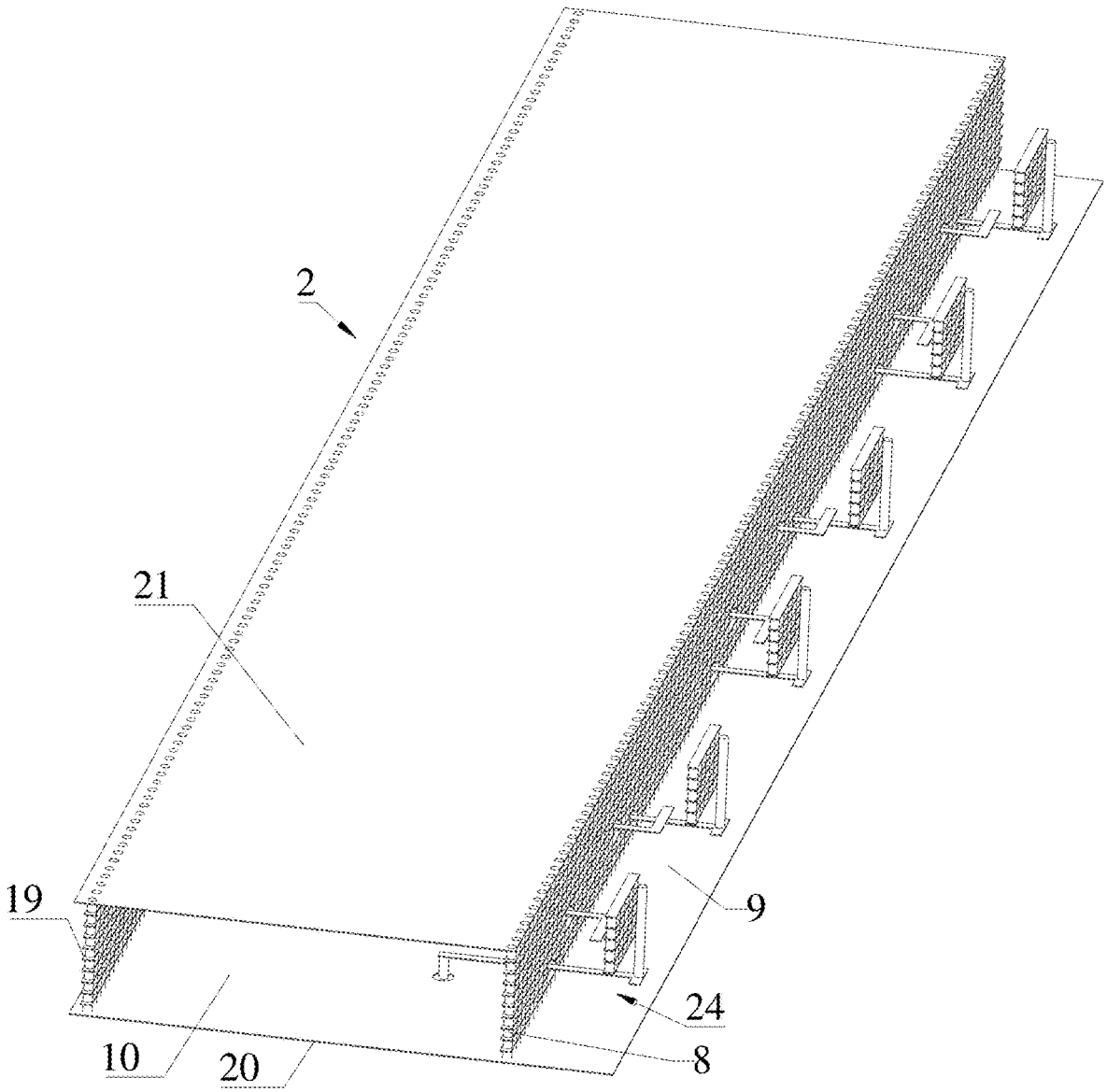
FIG. 3 is a structural view of a 5G MMW dual-polarized antenna module in Embodiment of the invention (a substrate is hidden)

Referring to FIG. 1 to FIG. 15, Embodiment 1 of the invention provides a terminal device which comprises, as shown in FIG. 1 to FIG. 3, a PCB 1, a 5G MMW dual-polarized antenna module 2 disposed on one side of the PCB 1, and a mobile phone frame 3, wherein the PCB 1 is disposed in the mobile phone frame 3, and a notch 4 for accommodating a part of the 5G MMW dual-polarized antenna module 2 is formed in the mobile phone frame 3.

Referring to FIG. 3 to FIG. 6, the 5G MMW dual-polarized antenna module 2 comprises a substrate 5, wherein a metal ground 8 and at least one antenna unit group 24 are disposed in the substrate 5, the metal ground 8 partitions the substrate 5 into a first region 9 and a second region 10, a first ground layer 20 conductive with the metal ground 8 is disposed on the bottom surface of the substrate 5 and has a first feed port 6 and a second feed port 7 below the second region 10, the antenna unit group 24 includes a first antenna unit 12 and a second antenna unit, the second antenna unit comprises a patch antenna 11 and a probe 13, the patch antenna 11 is parallel to the metal ground 8, the first antenna unit 12 comprises a first branch 14 and a second branch 15 connected to the first branch 14, the first branch 14 is disposed in the first region 9 in a height direction of the substrate 5 and is located on one side of the patch antenna 11, and an end, away from the first branch 14, of the second branch 15 is located in the second region 10 and is conductive with the first feed port 6; and the probe 13 comprises a first part 16 and a second part 17 connected to the first part 16, wherein the second part 17 is disposed in the first region 9 in a length direction of the substrate 5 and is located between the patch antenna 11 and the metal ground 8, an end, away from the second part 17, of the first part 16 is located in the second region 10 and is conductive with the second feed port 7, and the first part 16 penetrates through a through hole in the metal ground 8. In this embodiment, the probe 13 is in an L shape.

Figure 6:
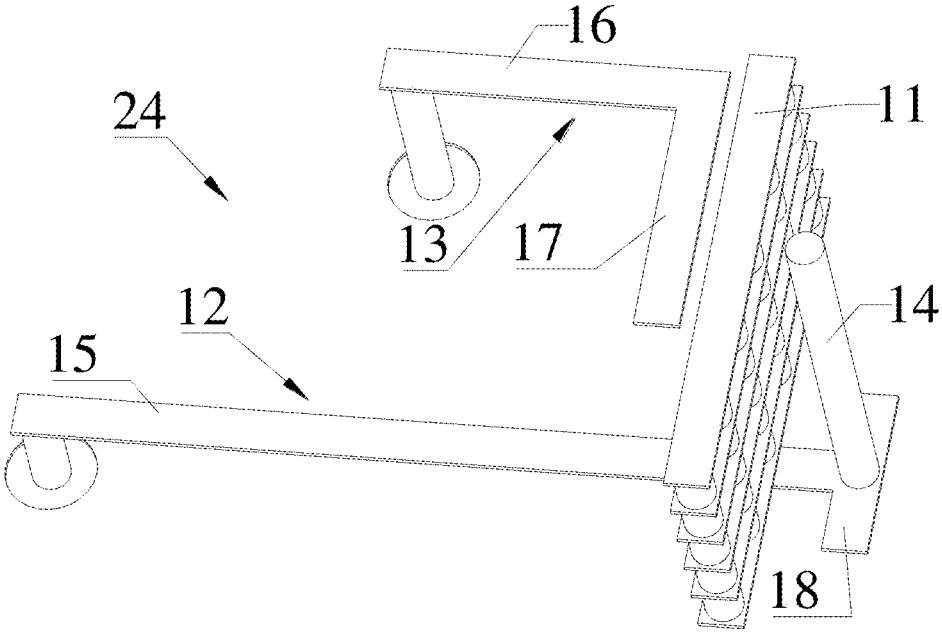
FIG. 6 is a partial structural view of an antenna unit of the 5G MMW dual-polarized antenna module in Embodiment 1 of the invention.

As shown in FIG. 6, the first antenna unit 12 further comprises a third branch 18 disposed in the length direction of the substrate 5, wherein the first branch 14 and the second branch 15 are connected through the third branch 18, and a joint of the first branch 14 and the third branch 18 is located in the middle of the third branch 18. In this embodiment, the second branch 15 and the third branch 18 form a T shape.

Figure 5:
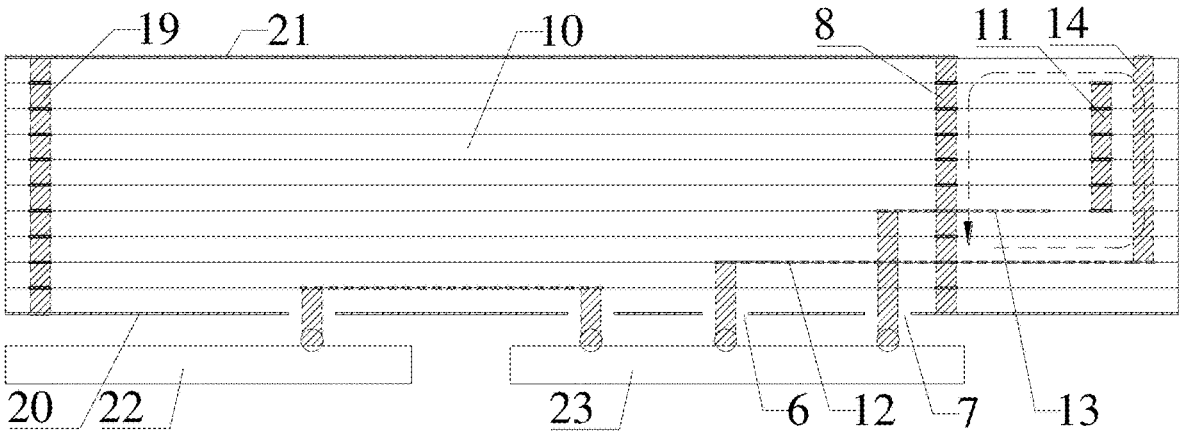
FIG. 5 is a sectional view of the 5G MMW dual-polarized antenna module in Embodiment 1 of the invention.

Referring to FIG. 5 and FIG. 6, the substrate 5 is of a multi-layer structure and can be manufactured through a multi-layer circuit board or LTCC process. To facilitate machining, the patch antenna 11 may be a mesh structure. Particularly, the patch antenna comprises multiple metal patches which are disposed in the height direction of the substrate 5 in an aligned manner, and every two adjacent metal patches are conductive with each other. Particularly, the second branch 15, the third branch 18, the first part 16 and the second part 17 are all in the shape of rectangular sheet, and the first branch 14 is cylindrical. The distance from the second branch 15 to the bottom surface of the substrate 5 is smaller than the distance from the patch antenna 11 to the bottom surface of the substrate 5. More particularly, the first branch 14 and the second part 17 are located on the same side of the patch antenna 11 or are located on different sides of the patch antenna 11 (in this embodiment, the first branch 14 and the second part 17 are located on different sides of the patch antenna 11).

To facilitate machining, the metal ground 8 is in a mesh shape. A meshed shield ground 19 is disposed at an end, away from the first region 9, of the second region 10 and is parallel to the metal ground 8. In this embodiment, the first ground layer 20 is conductive with the metal ground 8 and the shield ground 19, and a second ground layer 21 which is conductive with the metal ground 8 and the shield ground 19 is disposed at the top of the second region 10. In this way, the second region 10 serves as a metal cavity for accommodating feed lines, filters and switches, so that the space occupied by the antenna module is reduced, and a terminal device is made lighter and thinner, accordingly. In addition, under the shielding effect of the first ground layer 20, the second ground layer 21, the metal ground 8 and the shield ground 19, components in the metal cavity are prevented against disturbance from the outside, and the antenna unit group 24 is also prevented against disturbance, so that the performance of the antenna module is guaranteed.

Figure 4:
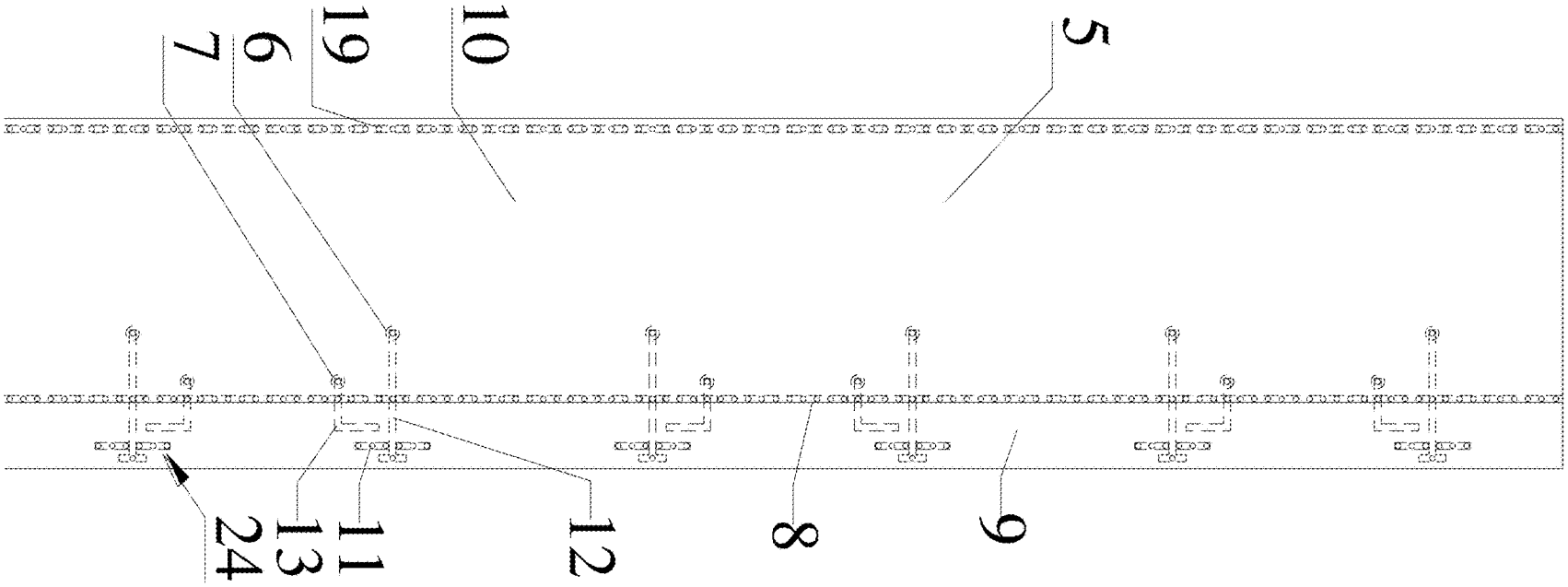
FIG. 4 is a top view of the 5G MMW dual-polarized antenna module in Embodiment 1 of the invention.

Referring to FIG. 3 and FIG. 4, multiple antenna unit groups 24 are disposed in the substrate 5 in an array manner. In this embodiment, the number of the antenna unit groups 24 is six.

Furthermore, as shown in FIG. 5, a digital integrated circuit chip 22 and a radio frequency chip 23 are disposed on the lower surface of the first ground layer. The radio frequency chip excites the multiple antenna unit groups 24. The radio frequency chip 23 comprises a phase shifter, an amplifier, and other elements, wherein the phase shifter can provide a phase difference for the antenna unit groups 24 to fulfill a beam scanning capacity of the antenna module, and the amplifier can compensate for the loss of the phase shifter. The digital integrated circuit chip 22 controls the radio frequency chip 23. Thus, the antenna module in this embodiment can be integrated with a radio frequency front end.

In this embodiment, the 5G MMW dual-polarization antenna module 2 operates at 37-40 GHz and adopts the LTCC process. When the substrate 5 is made of a dielectric with a dielectric constant of 5.9, the substrate 5 is formed by stacking ten single layers, wherein the height of each single layer is 100 um. The dimension $l_1$ of the patch antenna 11 in the length direction of the substrate 5 is about half of the wavelength, and the dimension $l_2$ of the patch antenna 11 in the height direction of the substrate 5 is far less than half of the wavelength. When power is fed to the antenna unit group 24 via the second feed port 7, the probe 13 can excite the patch antenna 11 to realize a TM01 mode to fulfill horizontal polarization. When power is fed to the antenna unit group 24 via the first feed port 6, an open-circuit loop antenna is formed by the first antenna unit 12 and the metal ground 8 to fulfill vertical polarization (because $l_2$ is far less than half of the wavelength, the first antenna unit 12 will not excite the patch antenna 11 in this case), and in this case, the perimeter of a loop (the loop with an arrow, indicated by the dotted line on the right of FIG. 5) is the key parameter that influences the operating frequency of the antenna unit group 24. Impedance matching can be adjusted by adjusting the distance from the third branch 18 to the bottom surface of the substrate 5, the outline dimension of the third branch 18 and the outline dimension of the second branch 15. As for horizontal polarization, the key parameter that influences the operating frequency of the antenna unit group 24 is $l_1$, and $l_2$ also has a slight influence on the operating frequency of the antenna unit group 24. In addition, the outline dimension and position of the probe 13 have an influence on matching. The position of the probe 13 has an impact on the isolation of vertical polarization and horizontal polarization.

Figure 7:
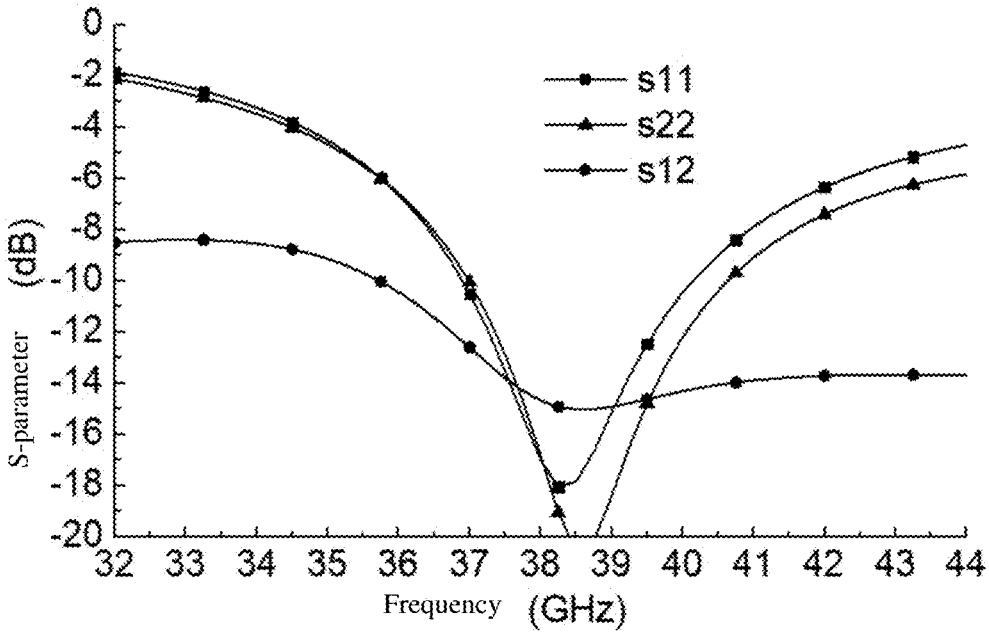
FIG. 7 is an S-parameter diagram of the antenna unit of the 5G MMW dual-polarized antenna module in Embodiment 1 of the invention.
Figure 8:
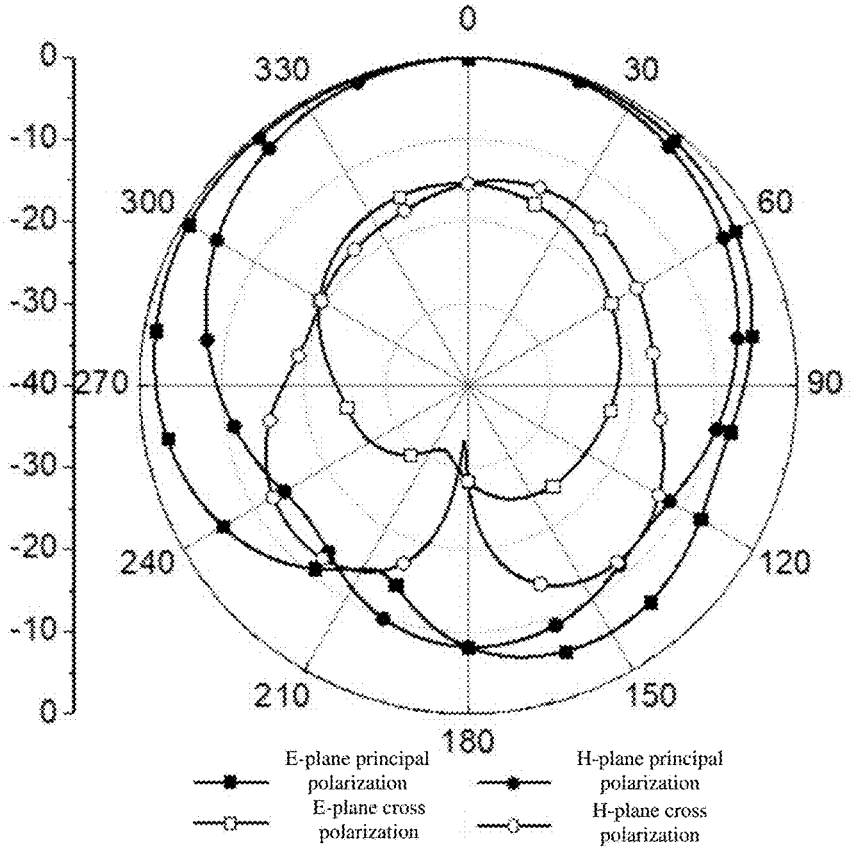
FIG. 8 is a radiation direction diagram of the antenna unit of the 5G MMW dual-polarized antenna module in Embodiment 1 of the invention (the antenna unit is excited via a first feed port)
Figure 9:
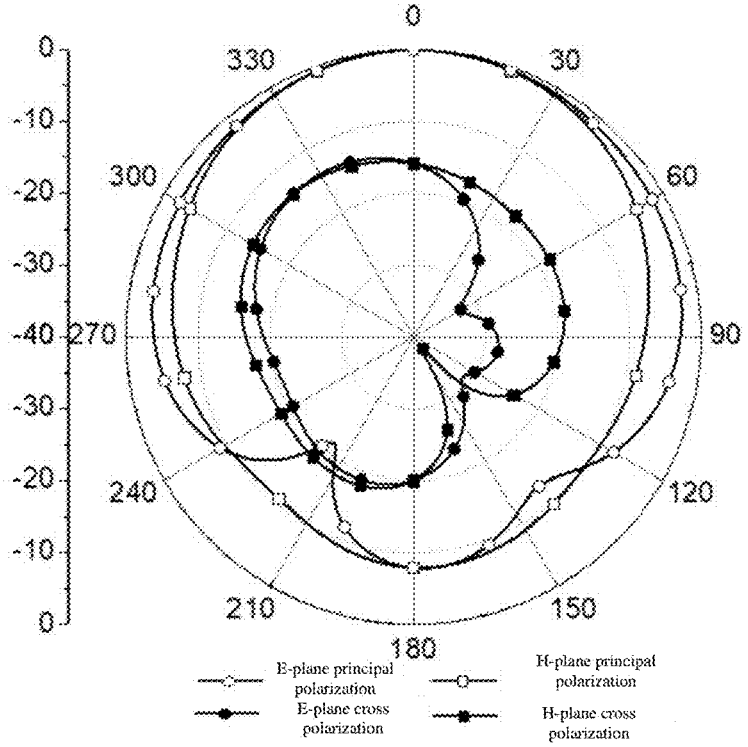
FIG. 9 is a radiation direction diagram of the antenna unit of the 5G MMW dual-polarized antenna module in Embodiment 1 of the invention (the antenna unit is excited via a second feed port)
Figure 10:
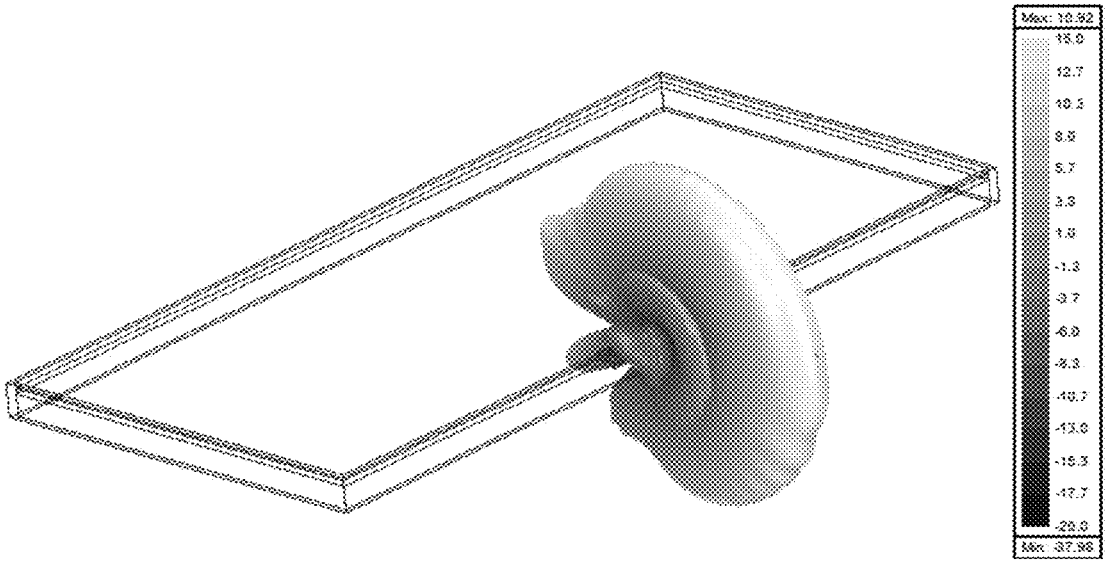
FIG. 10 is a 3D radiation direction diagram of the 5G MMW dual-polarized antenna module in the terminal device at 38.5 GHz in Embodiment 1 of the invention (under vertical polarization and a scan angle of 0°)
Figure 11:
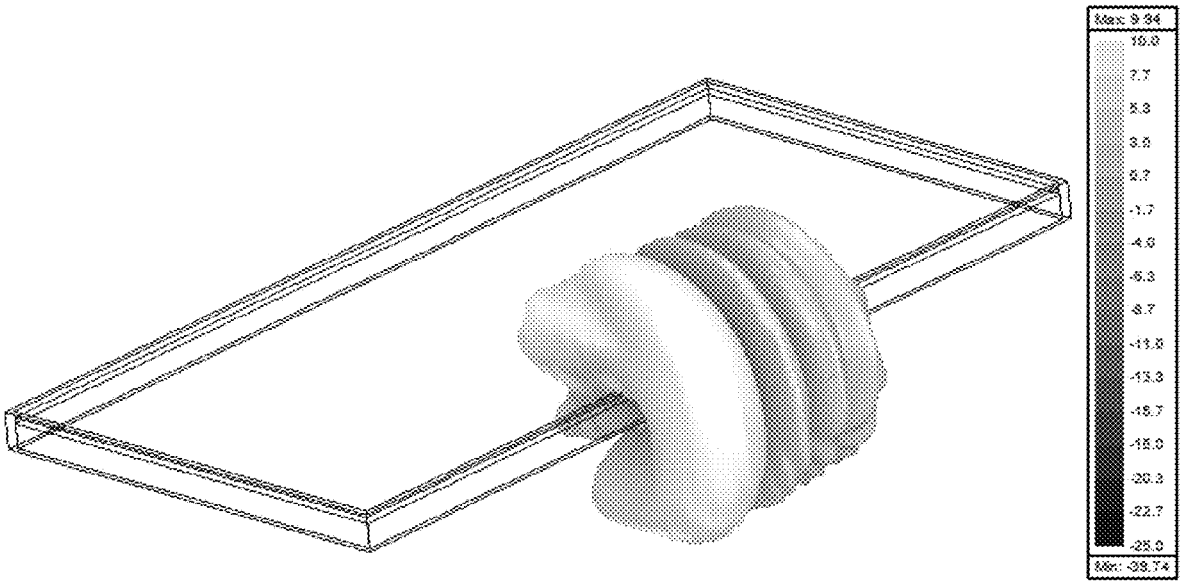
FIG. 11 is a 3D radiation direction diagram of the 5G MMW dual-polarized antenna module in the terminal device at 38.5 GHz in Embodiment 1 of the invention (under vertical polarization and a scan angle of 45°)
Figure 12:
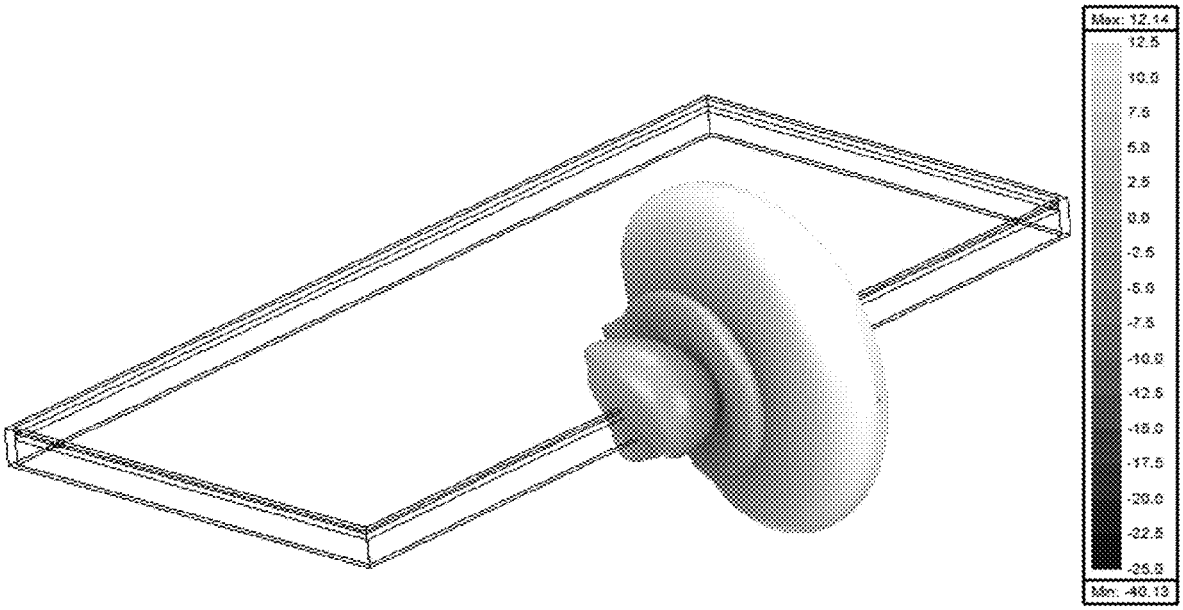
FIG. 12 is a 3D radiation direction diagram of the 5G MMW dual-polarized antenna module in the terminal device at 38.5 GHz in Embodiment 1 of the invention (under horizontal polarization and a scan angle of 0°)
Figure 13:
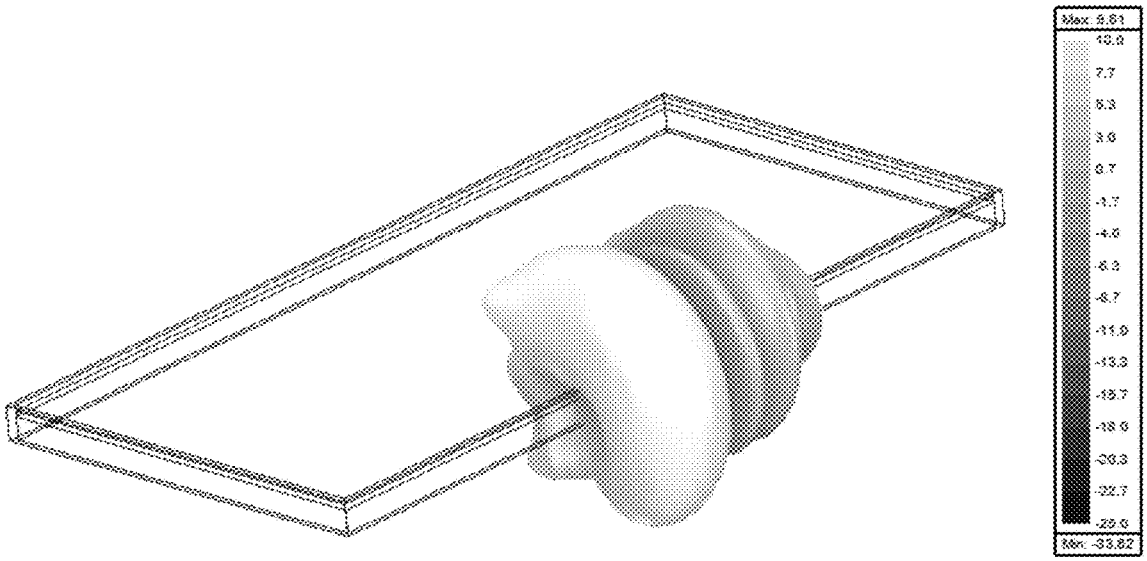
FIG. 13 is a 3D radiation direction diagram of the 5G MMW dual-polarized antenna module in the terminal device at 38.5 GHz in Embodiment 1 of the invention (under horizontal polarization and a scan angle of 45°)

FIG. 7 to FIG. 9 are simulated performance diagrams of the antenna unit group 24. As can be seen from FIG. 7 to FIG. 9, within the target operating frequency band of 37-40 GHz, the standing wave losses S11 and S22 are both less than −10 dB, and the isolation S21 of the two ports is superior to −12 dB. According to the direction diagrams of the antenna unit group 24, directed radiation is fulfilled, and cross polarization is good.

The applicant manufactured the 5G MMW dual-polarized antenna module 2 with six antenna unit groups 24, and a phase shifter was adopted to realize beam scanning. Meanwhile, in consideration of the influence of a terminal device on the antenna module, the applicant disposed the 5G MMW dual-polarized antenna module in a mobile phone and simulated the performance of the 5G MMW dual-polarized antenna module to better evaluate the 5G MMW dual-polarized antenna module.

Figure 14:
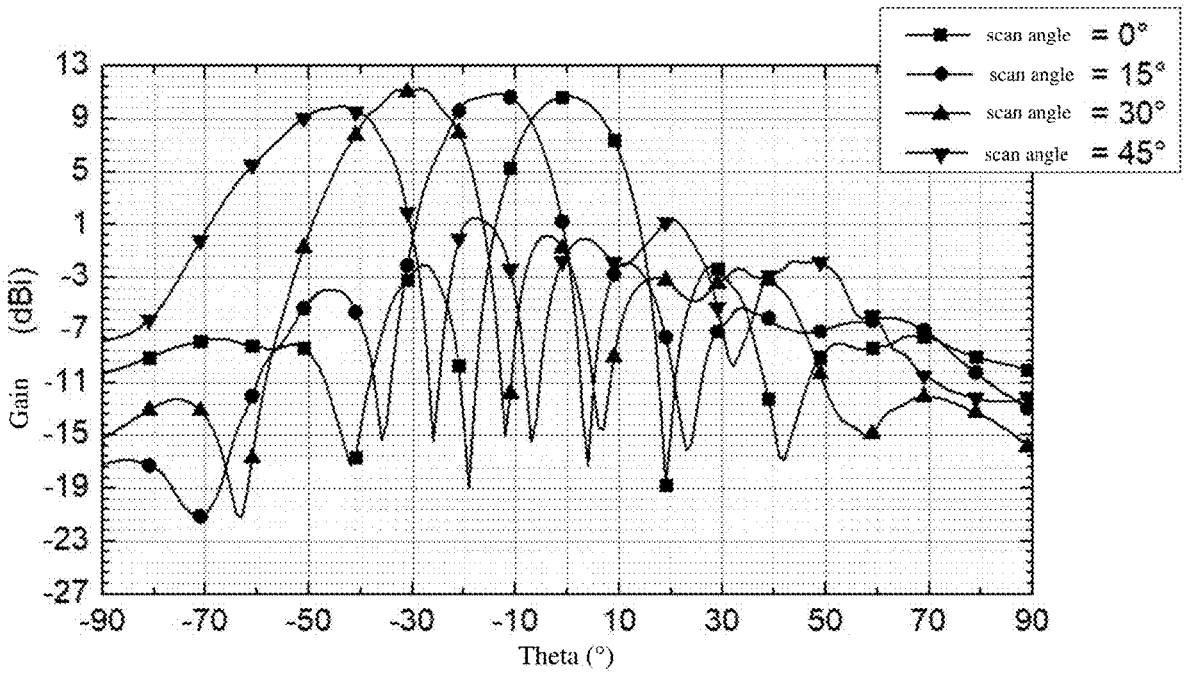
FIG. 14 is a scanning direction diagram of the 5G MMW dual-polarized antenna module at 38.5 GHz under vertical polarization and a scan angle of 0°-45° in Embodiment 1 of the invention.
Figure 15:
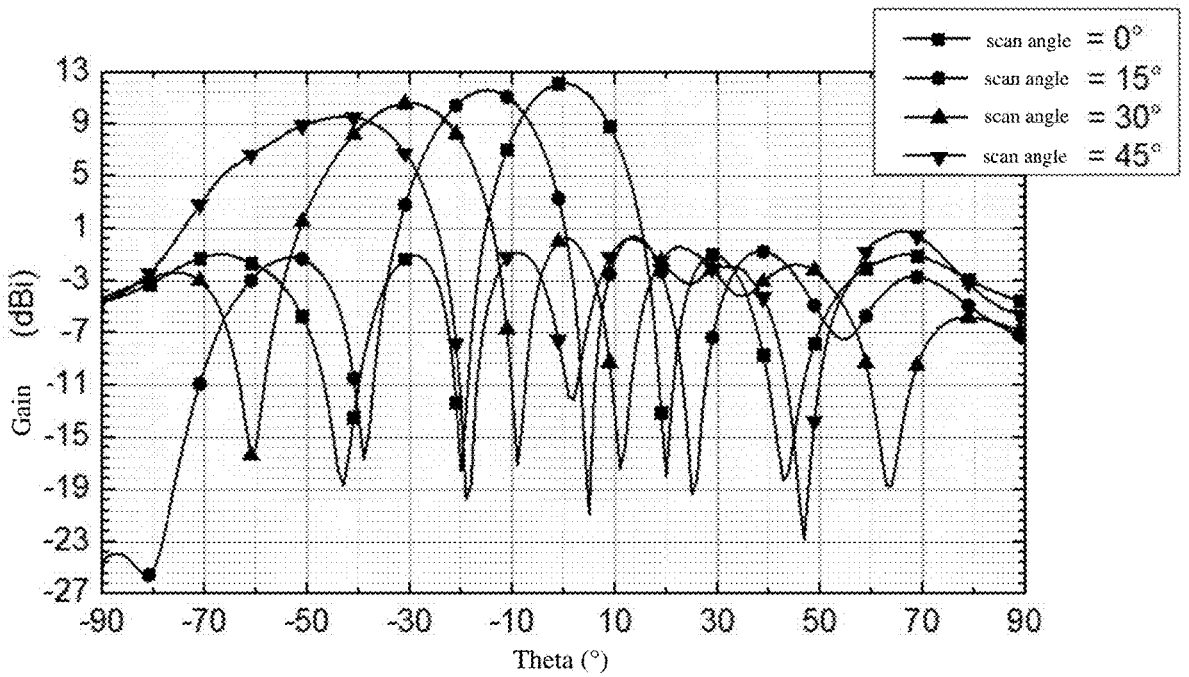
FIG. 15 is a scanning direction diagram of the 5G MMW dual-polarized antenna module at 38.5 GHz under horizontal polarization and a scan angle of 0°-45° in Embodiment 1 of the invention.

As shown in FIG. 1, in this embodiment, the antenna module is disposed on a side edge of a mobile phone and is located below a mainboard of the PCB. The mobile phone frame 3 is made of plastic or metal. In actual operation, a notch 4 should be formed in the mobile phone frame 3 to allow the MMW dual-polarized antenna module to be inlaid in the mobile phone frame 3. The MMW dual-polarized antenna module of this application has a small overall thickness (generally less than 2 mm), and thus has no influence on the thickness of the mobile phone. FIG. 10 to FIG. 13 are 3D direction diagrams of the MMW dual-polarized antenna module at 38.5 GHz. As can be clearly seen from FIG. 10 to FIG. 13, the MMW dual-polarized antenna module can fulfill lateral radiation to the mobile phone and has a beam scanning capacity. FIG. 14 and FIG. 15 are scanning direction diagrams of the MMW dual-polarized antenna module. As can be seen from FIG. 14 and FIG. 15, under vertical polarization within 0~45° and horizontal polarization within 0~45°, the gain in the direction diagrams is stable, and the scanning performance is good.

To sum up, the MMW dual-polarized antenna module in this embodiment is suitable for handheld devices of 5G communication systems and can completely cover the frequency band of n260 (37-40 GHz).

Embodiment 2

Figure 16:
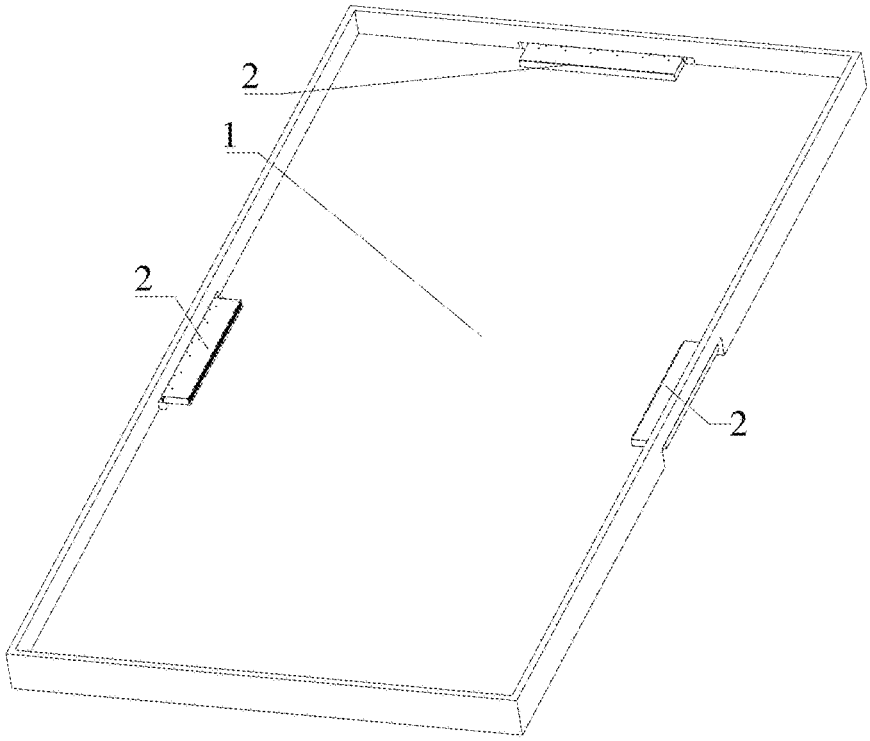
FIG. 16 is a structural view of a terminal device in Embodiment 2 of the invention.
Figure 17:
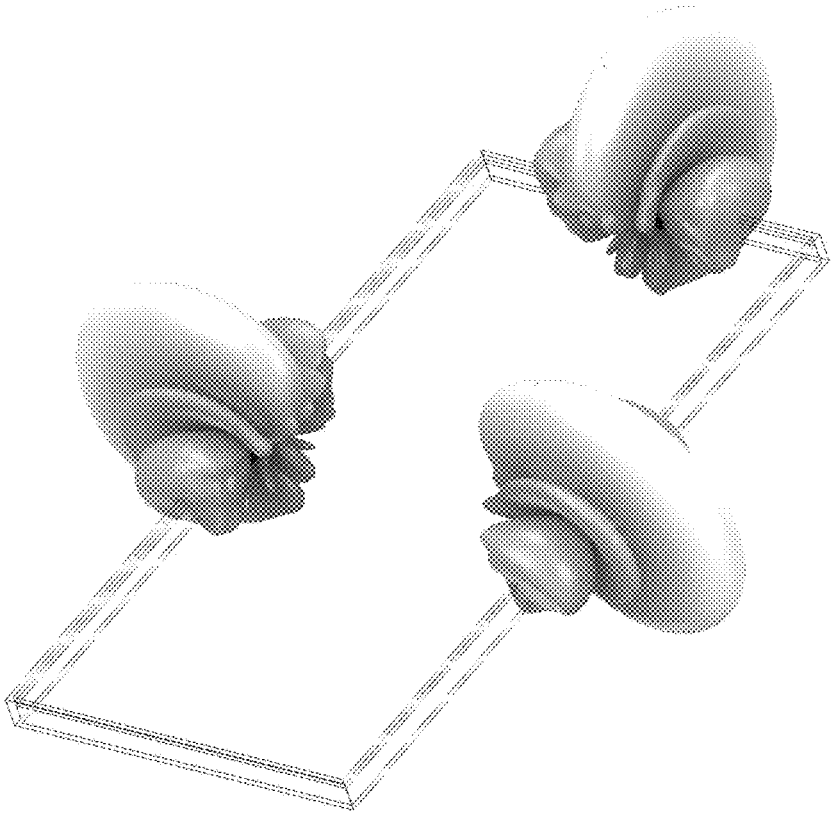
FIG. 17 is a 3D radiation direction diagram of the 5G MMW dual-polarized antenna module in the terminal device at 38.5 GHz in Embodiment 2 of the invention (under horizontal polarization and a scan angle of 0°).

Referring to FIG. 16 and FIG. 17, Embodiment 2 of the invention puts forwards another technical solution on the basis of Embodiment 1, and differs from Embodiment 1 in that the 5G MMW dual-polarized antenna modules 2 are respectively disposed on three sides of the PCB 1 of the terminal device to fulfill multidirectional coverage.

In conclusion, the 5G MMW dual-polarized antenna module and the terminal device provided by the invention can completely cover the frequency band of n260 (37-40 GHz), and the antenna module has good performance; the antenna module has the advantage of dual polarization, makes full use of the three-dimensional space of the terminal device, can be disposed in the terminal device to fulfill lateral radiation, and has a small thickness; and the antenna module is manufactured through a multi-layer circuit board or LTCC process, thus being more conducive to subsequent chip integration than metal frame-based designs.

The above description is merely used to illustrate the embodiments of the invention, and is not intended to limit the patent scope of the invention. All equivalent transformations made on the basis of the contents of the specification and the accompanying drawings, or direct or indirect applications to relating technical fields should also fall within the patent protection scope of the invention.

The invention claimed is:

1. A 5G millimeter wave dual-polarized antenna module comprising;

a substrate;

a metal ground disposed in the substrate, the metal ground partitioning the substrate into a first region and a second region;

a first ground layer conductive with the metal ground disposed on a bottom surface of the substrate, and the first ground layer has a first feed port and a second feed port below the second region; and at least one antenna unit group disposed in the substrate, the at least one antenna unit group including a first antenna unit and a second antenna unit, the second antenna unit including a patch antenna and a probe, the patch antenna being parallel to the metal ground, the first antenna unit including a first branch and a second branch connected to the first branch, the first branch being disposed in the first region in a height direction of the substrate and located on one side of the patch antenna, the second branch penetrating through a through hole in the metal ground, and an end of the second branch, which is located away from the first branch, is located in the second region and is conductive with the first feed port, wherein:

the probe includes a first part and a second part connected to the first part, the first part being disposed in the first region in a length direction of the substrate and located between the patch antenna and the metal ground, and an end of the first part, which is located away from the second part, is located in the second region and is conductive with the second feed port.

2. The 5G millimeter wave dual-polarized antenna module according to claim 1, wherein the first antenna unit further comprises a third branch disposed in the length direction of the substrate, and the first branch and the second branch are connected through the third branch.

3. The 5G millimeter wave dual-polarized antenna module according to claim 1, wherein the substrate is made of a multi-layer circuit board or low-temperature co-fired ceramic, and the patch antenna is a metal sheet structure or a metal mesh structure.

4. The 5G millimeter wave dual-polarized antenna module according to claim 3, wherein the metal ground is a metal sheet structure or a metal mesh structure.

5. The 5G millimeter wave dual-polarized antenna module according to claim 1, wherein a shield ground is disposed at an end, away from the first region, of the second region.

6. The 5G millimeter wave dual-polarized antenna module according to claim 1, wherein a second ground layer conductive with the metal ground is disposed at a top of the second region.

7. The 5G millimeter wave dual-polarized antenna module according to claim 1, wherein a digital integrated circuit chip and a radio frequency chip are disposed below the substrate, and the radio frequency chip is electrically connected to the first feed port, the second feed port and the digital integrated circuit chip.

8. The 5G millimeter wave dual-polarized antenna module according to claim 1, wherein the at least one antenna unit group includes a plurality of antenna unit groups that are disposed in the substrate in an array manner.

9. A terminal device comprising:

a printed circuit board; and a 5G millimeter wave dual-polarized antenna module disposed on at least one side of the printed circuit board, the 5G millimeter wave dual-polarized antenna module including:

a substrate;

a metal ground disposed in the substrate, the metal ground partitioning the substrate into a first region and a second region;

a first ground layer conductive with the metal ground disposed on a bottom surface of the substrate, and the first ground layer has a first feed port and a second feed port below the second region; and at least one antenna unit group disposed in the substrate, the at least one antenna unit group including a first antenna unit and a second antenna unit, the second antenna unit including a patch antenna and a probe, the patch antenna being parallel to the metal ground, the first antenna unit including a first branch and a second branch connected to the first branch, the first branch being disposed in the first region in a height direction of the substrate and located on one side of the patch antenna, the second branch penetrating through a through hole in the metal ground, and an end of the second branch, which is located away from the first branch, is located in the second region and is conductive with the first feed port, wherein:

the probe includes a first part and a second part connected to the first part, the first part being disposed in the first region in a length direction of the substrate and located between the patch antenna and the metal ground, and an end of the first part, which is located away from the second part, is located in the second region and is conductive with the second feed port.

10. The terminal device according to claim 9, wherein the first antenna unit further comprises a third branch disposed in the length direction of the substrate, and the first branch and the second branch are connected through the third branch.

11. The terminal device according to claim 9, wherein the substrate is made of a multi-layer circuit board or low-temperature co-fired ceramic, and the patch antenna is a metal sheet structure or a metal mesh structure.

12. The terminal device according to claim 11, wherein the metal ground is a metal sheet structure or a metal mesh structure.

13. The terminal device according to claim 9, wherein a shield ground is disposed at an end, away from the first region, of the second region.

14. The terminal device according to claim 9, wherein a second ground layer conductive with the metal ground is disposed at a top of the second region.

15. The terminal device according to claim 9, wherein a digital integrated circuit chip and a radio frequency chip are disposed below the substrate, and the radio frequency chip is electrically connected to the first feed port, the second feed port and the digital integrated circuit chip.

16. The terminal device according to claim 9, wherein the at least one antenna unit group includes a plurality of antenna unit groups that are disposed in the substrate in an array manner.

* * * * *